United States Patent [19]

Speer

[11] 4,176,612

[45] Dec. 4, 1979

[54] CERAMIC FERRULE

[76] Inventor: Kenneth Speer, Box 1115, Jal, N. Mex. 88252

[21] Appl. No.: 884,627

[22] Filed: Mar. 6, 1978

[51] Int. Cl.[2] ..... F23M 9/00

[52] U.S. Cl. ..... 110/323; 165/134 R

[58] Field of Search ..... 110/322, 323, 326; 165/134; 122/365, 501, 502

[56] References Cited

U.S. PATENT DOCUMENTS

| | | | |
|---|---|---|---|
| 1,031,992 | 7/1912 | Ford | 110/326 |
| 1,894,957 | 1/1933 | Lucke et al. | 165/134 |
| 2,252,069 | 8/1941 | Fletcher | 122/165 |
| 2,298,857 | 10/1942 | Clark | 110/323 |
| 3,707,186 | 12/1972 | Zorilla et al. | 165/134 |

*Primary Examiner*—Kenneth W. Sprague

*Attorney, Agent, or Firm*—Clarance A. O'Brien; Harvey B. Jacobson

[57] ABSTRACT

A double-ring ceramic ferrule member insertable into a fire tube of a sulfur plant boiler or cooler, the invention comprises an article of manufacture capable of reducing damage caused by high temperature gas flow through a fire tube, thereby to protect the fire tube and the tube sheet through which the fire tube extends. The present ferrule member provides improved anchoring capability and increased resistance to fire tube erosion.

10 Claims, 2 Drawing Figures

CERAMIC FERRULE

BACKGROUND OF THE INVENTION

1. Field of the Invention

The invention generally relates to ceramic ferrule structures which are used for the protection of fire tubes and associated tube sheets used in sulfur plant boiler and cooler apparatus, the invention particularly relating to a double-ring ceramic ferrule having improved anchoring capability and increased resistance to tube erosion.

2. Description of the Prior Art

Devices capable of protectively insulating against heat flow through pipe structure have long been known in the art. In particular, concentric pipe structures particularly suited for low temperature insulation are disclosed by Kobres in U.S. Pat. No. 4,014,369. Fink, et al., and Bittner, in U.S. Pat. Nos. 3,409,731 and 3,626,987, respectively, disclose coaxial cable and coaxial piping systems wherein one member disposed concentrically of a second member is utilized to insulate portions of the total structure. Stocker, in U.S. Pat. No. 1,153,724, and Torti, in U.S. Pat. No. 3,318,340, disclose lining structures for pipes and the like, which protect the exterior portions of the assembly from corrosive materials or thermal effects of a material passing through the interior of the pipe. In the particular use situation to which the present invention provides improvement, that is, in the protection of fire tubes and associated tube sheets used in sulfur boilers and coolers, ceramic insert tubes have previously been used for disposition within a fire tube in order to prevent burn out of the fire tube by the high temperature gas flow normally directed through said fire tube. The ceramic tubular members presently used in such situations are subject to slippage from the fire tubes due to the fact that the single anchoring ring disposed on the exterior surface of the ceramic member at the inlet end of the fire tube is inadequate to maintain the ceramic member in place within the fire tube. Accordingly, such fire tubes and the associated tube sheets through which the fire tubes pass frequently burn out and are otherwise thermally damaged, thereby causing expensive replacement and maintenance problems. The present invention provides structure characterized by improved anchoring and protective capability, the present article of manufacture being particularly useful for protection of fire tubes and associated tube sheets in sulfur boilers utilized to extract sulfur from natural gas.

SUMMARY OF THE INVENTION

Natural gas typically cannot be utilized or disposed of until the sulfur content thereof is substantially reduced, substantial penalties being imposed for flaring of "sulfur gas" during the production of natural gas. Apparatus known as sulfur boilers and coolers are used to extract sulfur from natural gas. These sulfur boilers are typically comprised of a structure containing water which absorbs heat from a hot gas flow directed through fire tubes disposed in the water, heat being thereby exchanged. The water is contained within a structure having walls which are commonly referred to as a tube sheet, the fire tubes extending through the tube sheet. According to the present invention, a double-ring ceramic ferrule is inserted into each fire tube, approximately ½ the length of the ceramic ferrule being received within said fire tube. A first ferrule ring is disposed substantially medially of the length of the ceramic ferrule on the exterior surface thereof, the ferrule ring being annular in conformation. This first ferrule ring extends substantially into abutment with the inlet end of the fire tube. A second annular ferrule ring is disposed outwardly of the first ferrule ring on the exterior surface of the ceramic ferrule. Castable refractory material is formed over that portion of the ceramic ferrule extending externally of the fire tube, that is, the portion of the ceramic ferrule having the first and second ferrule rings disposed thereon. The castable refractory material serves to insulate and hold the structure, the ferrule rings acting to anchor the ceramic ferrule within the refractory material and thus to maintain the ferrule in place within the fire tube. Increased protective capability is thereby provided to the fire tube. Hot gas flow is thus directed through the ceramic ferrule and into the fire tube, the ceramic ferrule extending sufficiently into the fire tube such that the hot gas flow does not directly contact the fire tube along portions of the fire tube which contact the tube sheet. Accordingly, the hot gas flow directly contacts the fire tube only along portions thereof which are in cooling contact with water contained within the boiler structure.

It is, therefore, an object of the present invention to provide a ceramic ferrule structure having increased anchoring capability in order that fire tubes and tube sheets through which the fire tubes extend in sulfur plant boiler structures are better protected.

It is another object of the present invention to provide a ceramic ferrule member having annular anchoring rings disposed on external surfaces of the ceramic ferrule exteriorly of a fire tube into which a portion of the ceramic ferrule extends.

It is a further object of the invention to provide a ceramic ferrule member having increased anchoring capability and which provides improved resistance to sulfur plant boiler tube erosion.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
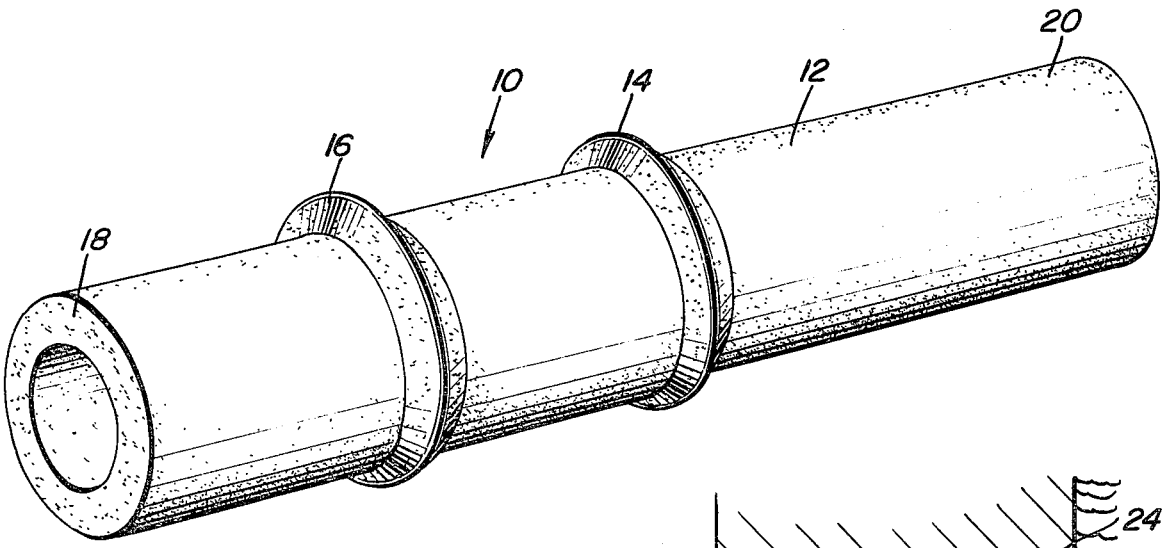
FIG. 1 is a perspective view of the ceramic ferrule member of the invention; and, FIG. 2 is an elevational view in section of the ceramic ferrule member of the invention received within a fire tube in a use situation.

Referring now to the drawings and particularly to FIG. 1, a ceramic ferrule member structured according to the present invention is seen generally at 10 to comprise a tube body 12 having at least two annular ferrule rings 14 and 16 formed on the exterior surface thereof, the first annular ferrule ring 14 being disposed substantially medially of the length of the tube body 12 while the second annular ferrule ring 16 is disposed between the first ring 14 and outer end 18 of the tube body 12. The ceramic ferrule member 10 is preferably molded of conventional ceramic slip material, zirconium oxide being added to the ceramic slip material in order to increase the melting point of the member 10 and to provide a relatively low coefficient of expansion to the material from which the member 10 is formed. The ceramic ferrule member 10 is typically formed with a wall thickness of ⅛ inch, the member being hollow in order to allow gas flow longitudinally therethrough. During formation of the ceramic ferrule member 10, the ceramic slip material from which the member 10 is formed is typically kiln fired at temperatures exceeding 2,000° F. The ceramic ferrule member 10 is, therefore, capable of providing thermal resistance to high temperature gas flow through the interior thereof.

Figure 2:
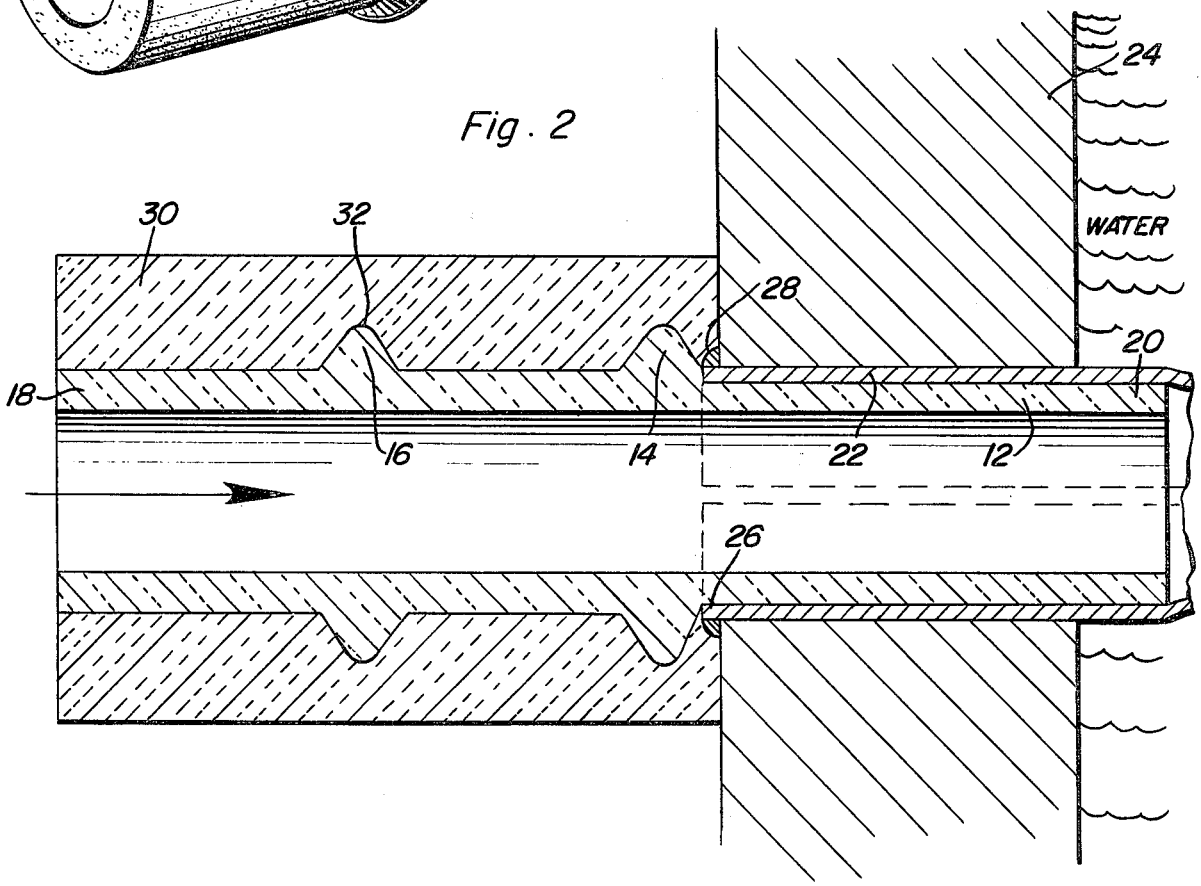

As particularly seen in FIG. 2, the ceramic ferrule member 10 of FIG. 1 is seen in actual use in the particular use situation to which the present invention is directed, that is, in a sulfur plant boiler used for the extraction of sulfur from natural gas. Inner end 20 of the ceramic ferrule member 10 is seen to be received within a fire tube 22, the fire tube 22 extending through a tube sheet 24 according to common practice in the art. The fire tube 22 extends through the tube sheet 24 and into a volume of water disposed on the interior surfaces of the tube sheet 24. Inlet end 26 of the fire tube 22 is attached to external wall surfaces of the tube sheet 24 by means of a weld seal 28, such as is well-known in the art. In order to protect those portions of the fire tube 22 which contact the tube sheet 24 as well as to protect the tube sheet 24 from thermal damages caused by a flow of high temperature gas through the inlet end 26 of said fire tube 22, the ceramic ferrule member 10 is inserted into the inlet end 26 of the fire tube 22 as aforesaid. As seen in FIG. 2, the inner end 20 of the ceramic ferrule member 10 is caused to extend through the fire tube 22 at least to a point beyond the internal wall surfaces of the tube sheet 24. That is, those portions of the fire tube 22 contacting the tube sheet 24 also contact or are disposed in spaced relation to the ceramic ferrule member 10 on inner surfaces of said fire tube 22. The first annular ferrule ring 14 is positioned on the ceramic ferrule member 10 such that said ring 14 abuts the inlet end 26 of the fire tube 22. The first annular ferrule ring 14 thereby prevents further insertion of the ceramic ferrule member 10 into the fire tube 22. The second annular ferrule ring 16 is accordingly seen to be disposed in spaced relation to the inlet end 26 of the fire tube 22 and outwardly thereof.

On reception of the inner end 20 of the ceramic ferrule member 10 into the fire tube 22, a castable refractory material 30 is then formed over the exposed portions of the ceramic ferrule member 10, including the first and second annular ferrule rings 14 and 16. The outer end 18 of the ceramic ferrule member 10 is maintained in an open communicating relation with ambient surroundings in order that a high temperature flow of gas can be directed through the interior of the ferrule member 10 and into the fire tube 22. Disposition of the ceramic ferrule member 10 along those portions of the fire tube 22 contacting the tube sheet 24 prevents thermal damage to the fire tube 22 and the tube sheet 24. Interiorly of the tube sheet 24, the high temperature gas flow can be allowed to contact the fire tube 22 due to the fact that water is disposed about those portions of the fire tube 22 which extend outwardly of inner wall surfaces of the tube sheet 24, the water serving to extract heat from the fire tube 22 and thereby to protect those portions of the fire tube 22 from thermal damage.

The ceramic ferrule member 10 is seen to be anchored in place within the fire tube 22 by means of the anchoring action of the first and second annular ferrule rings 14 and 16 embedded within the refractory material 30. As particularly seen in FIG. 2, the first and second annular ferrule rings 14 and 16 are substantially triangular in cross section, the rings 14 and 16 tapering outwardly of the tube body 12 to form annular ridge portions 32 at the outermost extension thereof from the surface of said tube body 12. This improved anchoring of the ceramic ferrule member 10 within the refractory material 30 provides increased resistance to sulfur plant boiler tube erosion, the fire tubes 22 and tube sheets 24 which comprise such apparatus being better protected against the potentially damaging thermal effects of the high temperature gas flow through the fire tubes 22.

The present invention, therefore, provides a ceramic ferrule structure having an increased capability for protecting fire tubes and associated tube sheets through which the fire tubes extend, such structure being particularly useful in sulfur plant boiler and cooler apparatus. The invention provides particular improvement by disposing spaced annular ferrule rings 14 and 16 over that portion of a ceramic ferrule which extends externally of a fire tube.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An improved ceramic ferrule structure for the protection of fire tube structures through which high temperature gas flows are directed, comprising:

a tubular body member formed of a thermally resistant material; and at least two annular ferrule rings formed on the external surface of the tubular body member, the rings being spaced apart, a body of refractory material being disposed over at least those portions of the tubular body member on which the ferrule rings are disposed, one of the ferrule rings being disposed substantially medially of the length of the tubular body member.

2. The structure of claim 1 wherein the other of the ferrule rings is disposed between the one ferrule ring and one end of the tubular body member, both ferrule rings being disposed outwardly of the fire tube structure with which the ferrule structure is associated.

3. The structure of claim 1 wherein the ferrule rings are triangular in cross section.

4. The structure of claim 1 wherein the ferrule rings are formed integrally with the tubular body member.

5. In a boiler structure formed of a tube sheet having a fire tube extending therethrough from an outer wall surface thereof to a water bath disposed interiorly of an inner wall surface thereof, a high temperature gas flow being directed through the fire tube, an improved ceramic ferrule member, comprising:

a tubular body member formed of a thermally resistant material, a portion of the tubular body member being received within the fire tube to protect the fire tube and portions of the tube sheet contacting the fire tube from thermal damage, the high temperature gas flow being received through the interior of the tubular body member received within said fire tube;

at least two annular ferrule rings formed on the external surface of the tubular body member, the ferrule rings being disposed on that portion of the tubular body member extending externally of the fire tube from the outer wall surface of the tube sheet, the rings being spaced apart; and, a body of refractory material disposed over that portion of the tubular body member disposed exteriorly of the outer wall surface of the tube sheet, the annular ferrule rings being disposed within the body of refractory material to anchor the ceramic ferrule member therein.

6. The ferrule member of claim 5 wherein the tubular body member extends beyond the inner wall surface of the tube sheet, thereby extending along all of the portions of the fire tube which contact the tube sheet.

7. The ferrule member of claim 5 wherein the ferrule rings are formed integrally with the tubular body member.

8. The structure of claim 1 wherein the ceramic ferrule structure is molded of ceramic slip material including a proportion of zirconium oxide, whereby the melting point of said structure is increased and the coefficient of expansion of said structure is decreased.

9. The structure of claim 8 wherein the fire tube structure is a sulfur plant boiler apparatus used for the extraction of sulfur from natural gas.

10. The ferrule member of claim 5 wherein the ceramic ferrule member is molded of ceramic slip material including a proportion of zirconium oxide, whereby the melting point of said member is increased and the coefficient of expansion of said member is decreased.

* * * * *